United States Patent [19]

Motsenbocker

[11] Patent Number: 4,550,918

[45] Date of Patent: Nov. 5, 1985

[54] TARGET ARRAY

[76] Inventor: Harold F. Motsenbocker, 15600 Morro Rd., Atascadero, Calif. 93422

[21] Appl. No.: 621,264

[22] Filed: Jun. 18, 1984

[51] Int. Cl.[4] ..... F41J 7/04

[52] U.S. Cl. ..... 273/385; 273/388; 273/391

[58] Field of Search ..... 273/383, 384, 385, 387, 273/388, 391, 392, 127 D

[56] References Cited

U.S. PATENT DOCUMENTS

| | | | |
|---|---|---|---|
| 3,411,784 | 11/1968 | Lawrence | 273/388 |
| 3,785,656 | 1/1974 | Gybowski | 273/127 D X |
| 3,792,859 | 2/1974 | Gybowski et al. | 273/41 |

*Primary Examiner*—Anton O. Oechsle
*Attorney, Agent, or Firm*—Daniel C. McKown

[57] ABSTRACT

A target array in which a struck pendulous target rotates past and interacts with a shock absorber before coming to rest in a set position on a ledge. The shock absorber consists of a laterally-extending shaft that extends through a piece of pipe. The diameter of the shaft is appreciably less than the inside diameter of the pipe, so that the pipe is pendulously supported on the shaft. The shaft is parallel to but spaced from the axis about which the target rotates. The spacing is such that as the struck target rotates it contacts and pushes aside the pipe, thereby transferring energy from the target to the pipe and preventing the target from rebounding when it reaches its set position resting on a laterally-extending ledge. The laterally-extending ledge also is rotatable about a laterally-extending axis and is connected to a resetting target. When the resetting target is struck, the impact causes the ledge to rotate out from under the set targets which descend by gravity to their original positions.

7 Claims, 10 Drawing Figures

TARGET ARRAY

BACKGROUND OF THE INVENTION

1. Field of the Invention

The present invention is in the field of targets of the type that are typically used for marksmanship practice, and more specifically relates to an array of targets that can be reset after any number of the targets have been struck, by hitting a special resetting target.

2. The Prior Art

Targets that pivot out of the way when struck have been known for a very long time. Likewise, it is an old expedient for the shooter to use a string to reset the target. The present invention belongs to a more sophisticated class of target arrays in which there is provided a distinct resetting target which when struck will cause the other targets to be restored to their initial position.

One of the earliest examples of this class of target array is disclosed in U.S. Pat. No. 996,712 issued July 4, 1911 to Harper. Harper shows a target mounted to the upper arm of a compound pendulum that also includes a lower arm. When the target is struck, the arms rotate and the tip of the lower arm rises, brushing past a leaf spring and, after the initial impluse is spent, coming to rest on top of the leaf spring. Each of several targets operates in this manner.

The leaf springs are mounted on a pivotable frame that is counterpoised against a stop. When the last of the targets has been struck, the combined weight of the lower arms of the compound pendulums resting upon the leaf springs is sufficient to cause the frame to tip over, thereby releasing the lower arms and permitting the targets to return to their initial positions and permitting the frame to return under the action of the counterweight to its initial position.

It should be noted that this target array can be reset only by striking all of the targets. It is also clear that the compound pendulum needs to be adjusted carefully to prevent excessive rebound.

The same inventor (Harper) describes what may be thought of as an upside-down version of his earlier device in U.S. Pat. No. 1,098,255 issued May 26, 1914. In this newer version, the target is mounted on the lower arm of a compound pendulum, and the tip of the upper arm of the pendulum supports a pivoting frame on which the latches for the individual targets are mounted. When struck, a target swings rearwardly and upwardly until it engages the latch which holds the target in its set position.

Since the frame on which the latches are mounted is supported by the tips of the upper arms of the target pendulums, it follows that when the last remaining target is struck, the frame becomes unsupported and pivots downwardly under the action of gravity, and this motion releases the latches, permitting the targets to return to their initial position. As the targets return to their initial positions, the tips of the upper arms of the target pendulums push the frame back to its original position. Here again, it is noted that the array is reset only after all of the targets have been struck.

In U.S. Pat. No. 1,754,030 issued April 8, 1930, Mattson describes a target that presents the appearance of a human body, the arms, legs and head of which fold back out of sight when struck. These body parts are held in their initial positions by springs or by gravity, and when driven back by a blow they are retained in the retracted position by a rachet-like detent.

A reset target is provided at the center of the figure, which when struck releases the pawls of the ratchets 1 thereby permitting the set body parts to return to their initial positions under the action of the springs or gravity.

In U.S. Pat. No. 3,411,784, issued November 19, 1968 to Lawrence, there is described a resettable target array in which individual pendulous targets swing rearwardly and upwardly, passing overcenter and coming to rest against a laterally extending stop bar. A master target is provided and it includes a crossbar that extends laterally from the arm of its pendulum. When the master target is struck, the crossbar pushes the arms of the other targets back overcenter so that they can swing back to their initial position. There is no provision to prevent bouncing of the individual targets from the stop bar.

Thus, recycling targets have evolved over many years and a number of such targets have been patented. However, the particular design of the present invention does not appear to have been discovered.

It is an object of the present invention to provide a resettable target that is extremely rugged, so as to withstand high power rifle bullets, extremely reliable, and less susceptible to bouncing of the targets from their set position. Also, it will be seen that the target array of the present invention can be constructed in a simple manner from readily available stock.

SUMMARY OF THE INVENTION

The present invention provides an array of targets that can be reset to an initial position regardless of how many of the targets have been struck.

Each pendulous target when struck by a bullet swings rearwardly and upwardly passing overcenter and eventually coming to rest on a ledge after pivoting through approximately 270 degrees in a preferred embodiment. After passing over dead center, the tip of the target strikes a unique shock absorber that is a notable feature of the present invention.

The shock absorber includes a laterally extending pipe through which passes a laterally extending shaft whose diameter is appreciably less than the inside diameter of the pipe. The shaft is so positioned with respect to the axis about which the target rotates that after the target has passed overcenter, the tip of the target brushes past the pipe, contacting the pipe and pushing it aside to permit the target to pass by. Thereafter, the tip of the target impacts on the ledge while the pipe moves back to its initial equilibrium position under the action of gravity. If the target then rebounds from the ledge, it again strikes the pipe, but does not have sufficient energy to shove the pipe aside, and so the target falls again to the ledge.

The ledge on which the set targets come to rest is itself pivotable, and in fact pivots about the shaft that passes through the pipe when a bullet strikes a special target that is connected to the ledge. This pivoting of the ledge permits the set targets to swing downwardly under the action of gravity to their initial position, having completed a full circle of rotation. Thereafter, gravity restores the ledge to its initial position.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and g are not intended as a definition of the limits of the invention.

DETAILED DESCRIPTION OF THE PREFERRED EMBODIMENT

Figure 3:
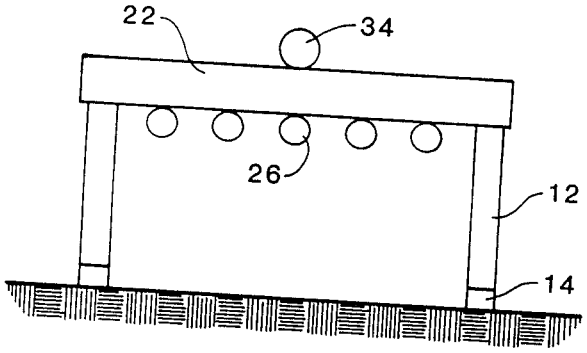
FIG. 3 is a front elevation view of the embodiment of FIG. 1.
Figure 2:
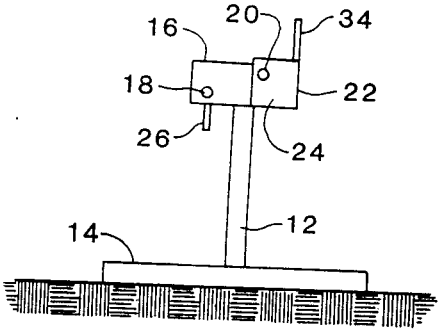
FIG. 2 is a side elevation view showing the left side of the embodiment of FIG. 1.

Turning now to the drawings in which similar parts are denoted by the same reference numeral throughout, it will be seen that the preferred embodiment includes an elongated target array 10 that is supported by legs 12 that terminate in feet 14. In an alternative embodiment, the length of the legs 12 is adjustable. The upper ends of the legs 12 are attached to the end plates 16.

A target shaft 18 is welded at each of its ends to one of the end plates 16. A shock absorber shaft 20 also extends the entire width of the target array and passes through an oversize hole in each of the end plates 16 so that the ends of the shock absorber shaft extend beyond the end plates 16.

Figure 4:
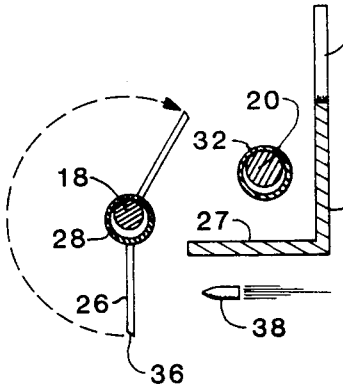
FIG. 4 is a diagram consisting of an end view in the direction 4—4 indicated in FIG. 1 and showing certain parts of the target array of FIG. 1 in an initial stage of operation.

A resetting member 22 consisting of a length of angle iron (as shown in FIG. 4) and including end plates 24 is provided at the front of the target array 10.

The ends of the shock absorber shaft 20 that extend beyond the end plates 16 are welded to the end plates 24 of the resetting member. In an alternative embodiment, the ends of the shock absorber shaft 20 are welded to the end plates 16 and the end plates 24 of the resetting member 22 are mounted for rotation on the shock absorber shaft 20.

Figure 1:
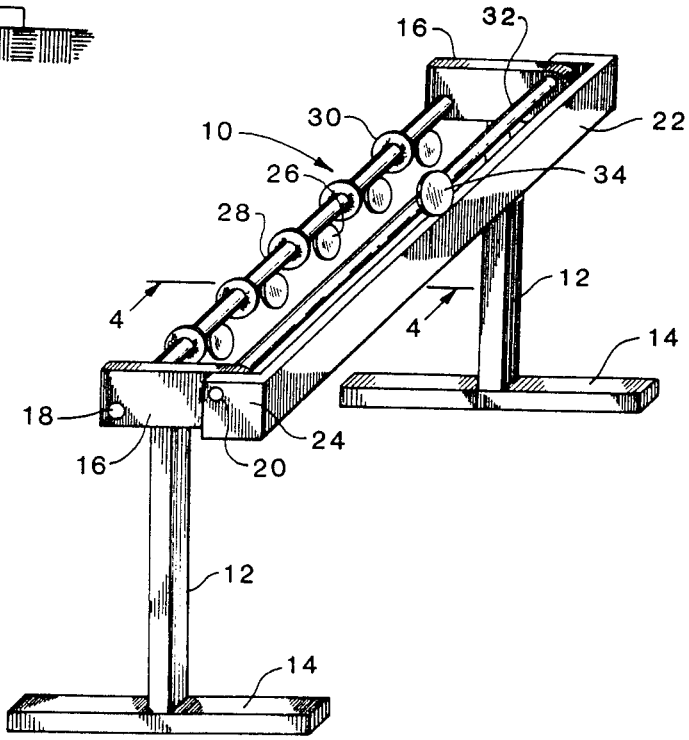
FIG. 1 is a perspective view showing the front, the left side and the top of a preferred embodiment of the target array of the present invention.
Figure 9:
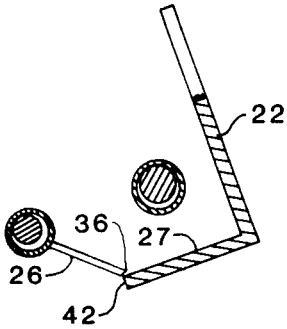
FIG. 9 is a diagram similar to the diagrams of FIGS. 4–8 and illustrating the resetting operation of the target array; and, FIG. 10 is a diagram similar to the diagrams of FIGS. 4–9 and showing a target that has been reset and is ready for use.

The lower and horizontally extending flange 27 of the resetting member 22 (best seen in FIG. 4) bears against the lower edge of the end plate 16 to prevent clockwise rotation of the resetting member 22 as viewed in FIG. 1. As will be seen below and as shown in FIG. 9, counterclockwise rotation of the resetting member is a necessary function.

Each of the targets 26 is welded to a segment of pipe 28. The target shaft 18 passes through each of the segments of pipe 28. In a preferred embodiment, the segments 28 of pipe are isolated from each other by the washers 30 to guard against the possibility that when one of the targets 26 is struck and its segment 28 rotates, its rotation might be imparted to adjacent targets by friction.

It is important that the segments of pipe 28 fit very loosely on the target shaft 18. In the preferred embodiment, the segments 28 have an inside diameter of about 0.625 inches, and the target shaft 18 has a nominal diameter of 0.375 inches. In this case, the actual clearance is approximately 0.25 inch in the preferred embodiment. Similarly, a shock absorber tube 32 fits loosely over the shock absorber shaft 20 and is free to rotate on the shock absorber shaft. In a preferred embodiment, the shock absorber tube is a single piece of tubing having a nominal outside diameter of 0.75 inch, and the shock absorber shaft 20 has a diameter of 0.50 inch, so that the actual clearance is approximately 0.13 inch in the preferred embodiment. In another embodiment, the single piece of tubing 32 is replaced by a number of segments of tubing, one for each target.

The resetting target 34 is welded to the upper edge of the resetting member 22. Thus, the entire resetting target 34 is located above the shock absorber shaft 20, so that when the resetting target 34 is struck, the resetting member 22 will rotate counterclockwise about the axis of the shock absorber shaft 20 (as indicated in FIG. 9).

FIGS. 4–10 are diagrams showing a cross-sectional view in the direction 4—4 indicated in FIG. 1. These figures show successive stages in a complete cycle of operation of the target array.

Figure 10:
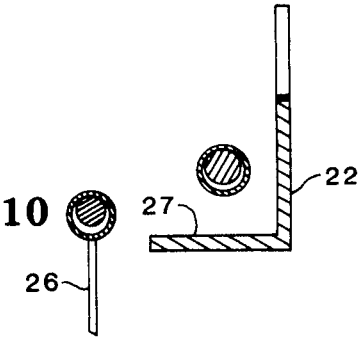

The initial position of the target is shown in FIGS. 4 and 10. A bullet 38 is assumed to strike the target 26 thereby causing the target to rotate very rapidly in the clockwise direction indicated in FIG. 4.

Figure 5:
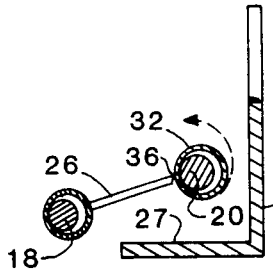
FIGS. 5–7 are diagrams similar to the diagram of FIG. 4 and showing successive stages in the setting of a target.
Figure 6:
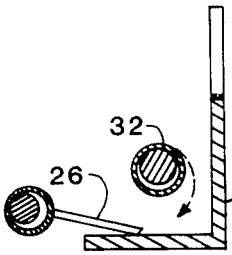

As shown in FIG. 5, the spacing between the axis of the target shaft 18 and the axis of the shock absorber shaft 20 is such that the tip 36 of the target 26 cannot avoid brushing against the shock absorber tube 32, thereby forcing the shock absorber tube to roll on the shock absorber shaft 20 in the direction indicated by the arrow. This motion of the shock absorber tube 32 moves it out of the way of the tip 36 of the target, thereby permitting the target to rotate to the position shown in FIG. 6. It is noteworthy that the shock absorber tube 32 is a single piece of material that extends the entire width of the target array, and as a result, the inertia of the entire shock absorber tube is available to absorb energy from the target 26. This has the advantage of causing a less severe impact when the tip 36 of the target hits the ledge 27 of the resetting member 22. The energy of the target that has been transferred to the shock absorber tube 32 is eventually dissipated by friction as the shock absorber tube rolls, slides, and oscillates on the shock absorber shaft 20.

Figure 7:
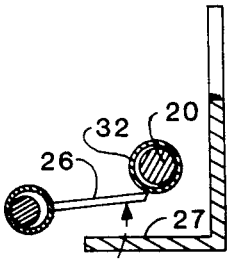

In the preferred embodiment of FIG. 7, the target 26 is shown rebounding from the ledge 27. Because some of the energy of the target has been absorbed, partly by the shock absorber tube 32 and partly by impact of the target against.the ledge 27, the target rebounds with considerably less energy than the energy with which it initially struck the shock absorber tube 32.

Figure 8:
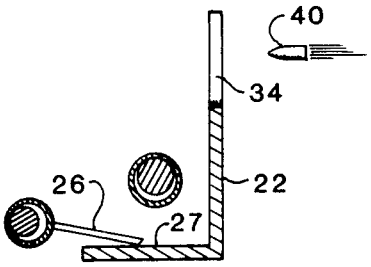
FIG. 8 is a diagram similar to the diagrams of FIGS. 4–7 and showing a target in its set position.

It should also be noted that the axis of the shock absorber shaft 20 is located higher than the axis of the target shaft 18. This causes the tip 36 of the target on its rebound motion to hit the underside of the shock absorber tube 32, as shown in FIG. 7, and thereby the already-depleted energy of the target 26 is exhausted in a vain attempt to lift as well as to push aside the shock absorber tube 32. The target 26 does not have sufficient energy to push aside the shock absorber tube 32 and therefore the target falls again to its set position on the ledge 27, as shown in FIG. 8.

It is to be noted that in the preferred embodiment, the tip 36 of the target is not squared off, but instead tapers outwardly from the rear surface of the target to the front surface of the target, as shown in the drawings.

The resetting action of the target array will be described next.

It should be noted that the array can be reset regardless of how many of the targets have been struck. It is not necessary that all of the targets 26 be set (struck) before the array is reset. In the drawings, only one set target will be shown, however, it should be clear that the action would be the same if any number of the targets had been set.

FIG. 8 shows one of the targets 26 in its set position and shows a bullet 40 about to strike the resetting target 34.

The impact of the bullet 40 causes the resetting member 22 to rotate counterclockwise to the position shown in FIG. 9. At this position, the tip 36 of the target is almost ready to clear the edge 42 of the ledge 27, and upon further rotation of the resetting member 22, the target 26 pivots clockwise under the action of gravity to the reset position shown in FIG. 10. The shock absorber tube 32 plays no part in the resetting action. Further counterclockwise rotation of the resetting member 22 appreciably beyond the position shown in FIG. 9 is prevented by the weight of the resetting member 22.

Thus, there has been described a target array in which any number of targets that have been set can be reset g by hitting the resetting target. The target array is noteworthy for its simple rugged construction. It consists of readily available components such as angle iron, pipe steel bars, and box tubing. Therefore, the lifetime of the target array is practically unlimited.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A target apparatus characterized in that the energy imparted to the target when it is struck is transferred to a shock absorber before the target reaches its set position and in which the target can thereafter be reset to its initial position, said target comprising in combination:

a frame;

a target pendulously mounted to said frame for rotation about a laterally-extending axis when struck;

tube means; and, shaft means mounted to said frame and extending laterally and through said tube means, said shaft means having a cross section appreciably smaller than the cross section of said tube means, whereby said tube means is pendulously supported by said shaft means;

said shaft means spaced far enough from the axis about which said target rotates that said target must push said tube means aside to rotate past said tube means, thereby transferring energy from said target to said tube means.

2. The target apparatus of claim 1 further comprising ledge means mounted to said frame for supporting said target in a set position and so located that said target when struck must rotate past said tube means before coming to rest on said ledge means.

3. The target apparatus of claim 2 further comprising:

mounting means for mounting said ledge means to said frame for rotation about a laterally-extending axis; and, a resetting target connected to said ledge means, whereby when said resetting target is struck, the impulse causes said ledge means to rotate out from under said target so as to let said target descend under its own weight to the initial position.

4. A target array characterized in having more than one target but only a single shock absorber so that when any of the targets is struck, the energy imparted to the struck target is transferred to the single shock absorber before the target reaches its set position, from which position the target can be reset to its initial position, said target array comprising in combination:

a frame;

a target shaft mounted to said frame and defining a laterally-extending axis;

more than one target pendulously mounted in juxtaposition along said target shaft for rotation about the laterally-extending axis when struck;

tube means; and, shaft means mounted to said frame and extending laterally and through said tube means, said shaft means having a cross section appreciably smaller than the cross section of said tube means, whereby said tube means is pendulously supported by said shaft means;

said shaft means spaced far enough from the axis about which said targets rotate that each of said targets when struck must push said tube means aside to rotate past said tube means, thereby transferring energy from said target to said tube means.

5. The target array of claim 4 further comprising ledge means mounted to said frame and extending laterally for supporting a struck target in a set position and so located that said struck target must rotate past said tube means before coming to rest on said ledge means.

6. The target array of claim 5 further comprising;

mounting means for mounting said ledge means to said frame for rotation about a laterally-extending axis; and, a resetting target connected to said ledge means, whereby when said resetting target is struck, the impulse causes said ledge means to rotate out from under said struck target so as to let said struck target descend under its own weight to the initial position.

7. In a target apparatus that includes a target that is pendulously mounted for rotation about a laterally-extending axis the improvement comprising:

tube means; and, shaft means extending laterally and through said tube means, said shaft means having a cross section appreciably smaller than the inside diameter of said tube means, whereby said tube means is pendulously supported by said shaft means;

said shaft means spaced far enough from the axis about which the target rotates that the target must push said tube means aside to rotate past said tube means, thereby transferring energy from the target to said tube means.

* * * * *